US010391415B2

(12) United States Patent
Park

(10) Patent No.: US 10,391,415 B2
(45) Date of Patent: Aug. 27, 2019

(54) CONNECTING MEMBER FOR SELF-ASSEMBLY TOY

(71) Applicant: GYMWORLD INC., Seoul (KR)

(72) Inventor: Kee Young Park, Seoul (KR)

(73) Assignee: GYMWORLD INC., Seoul (KR)

( * ) Notice: Subject to any disclaimer, the term of this patent is extended or adjusted under 35 U.S.C. 154(b) by 0 days.

(21) Appl. No.: 15/756,335

(22) PCT Filed: Sep. 5, 2016

(86) PCT No.: PCT/KR2016/009889
§ 371 (c)(1),
(2) Date: Feb. 28, 2018

(87) PCT Pub. No.: WO2017/039409
PCT Pub. Date: Mar. 9, 2017

(65) Prior Publication Data

US 2018/0256992 A1 Sep. 13, 2018

(30) Foreign Application Priority Data

Sep. 15, 2015 (KR) ..... 10-2015-0130609

(51) Int. Cl.
*A63H 33/04* (2006.01)
*A63H 33/08* (2006.01)
(Continued)

(52) U.S. Cl.
CPC ..... *A63H 33/086* (2013.01); *A63H 11/18* (2013.01); *A63H 17/264* (2013.01); *A63H 29/22* (2013.01);
(Continued)

(58) Field of Classification Search
CPC ..... A63H 11/18; A63H 33/08; A63H 31/06; A63H 31/00; A63H 17/264; A63H 33/086;
(Continued)

(56) References Cited

U.S. PATENT DOCUMENTS 1,914,515 A * 6/1933 Long ..... A63H 11/10 446/293
D96,616 S * 8/1935 Livingston ..... D11/160
(Continued)

FOREIGN PATENT DOCUMENTS

GB 2250214 B * 9/1994 ..... A63H 11/18
JP 2001-259245 A 3/2000
(Continued)

OTHER PUBLICATIONS

Magformers, Korean online content regarding products for 2015, 14 pages, retrieved from http://www.magformers.co.kr, accessed on Feb. 27, 2018.
(Continued)

*Primary Examiner* — Vishu K Mendiratta
(74) *Attorney, Agent, or Firm* — Kilpatrick Townsend & Stockton LLP

(57) ABSTRACT

As an embodiment of the present disclosure, a connection member of an assembly toy includes: a body formed as a solid figure similar to a rectangular parallelepiped, the body including a circular opening in a center of an upper surface and openings of oval shapes in a left side surface and a right side surface; a leg protruding out of the body through the openings of the oval shapes in the left and right side surfaces of the body; and foot models respectively connected to left and right end portions of the leg.

6 Claims, 6 Drawing Sheets

(51) Int. Cl.

| | |
|---|---|
| ***A63H 31/06*** | (2006.01) |
| ***A63H 17/26*** | (2006.01) |
| ***A63H 33/10*** | (2006.01) |
| ***A63H 11/18*** | (2006.01) |
| ***A63H 29/22*** | (2006.01) |
| ***A63H 31/08*** | (2006.01) |
| ***A63H 31/00*** | (2006.01) |
| *A63H 17/14* | (2006.01) |
| *A63H 33/06* | (2006.01) |
| *A63H 33/26* | (2006.01) |

(52) U.S. Cl.
CPC ..... *A63H 31/00* (2013.01); *A63H 31/06* (2013.01); *A63H 31/08* (2013.01); *A63H 33/08* (2013.01); *A63H 33/101* (2013.01); *A63H 17/14* (2013.01); *A63H 33/062* (2013.01); *A63H 33/088* (2013.01); *A63H 33/26* (2013.01)

(58) Field of Classification Search
CPC ..... A63H 33/101; A63H 29/22; A63H 31/08; A63H 17/14; A63H 33/062; A63H 33/088
USPC ..... 446/97, 102
See application file for complete search history.

(56) References Cited

U.S. PATENT DOCUMENTS

| | | | | | |
|---|---|---|---|---|---|
| 2,591,469 | A * | 4/1952 | Saito | A63H 11/00 | 446/356 |
| 3,083,504 | A * | 4/1963 | Abbott | A63H 11/10 | 446/291 |
| 3,611,626 | A * | 10/1971 | Borin | A63H 3/20 | 446/377 |
| 4,051,623 | A * | 10/1977 | Ogawa | A63H 11/00 | 446/290 |
| 4,182,076 | A * | 1/1980 | Gay | A63H 3/48 | 446/333 |
| 4,708,688 | A * | 11/1987 | Lee | A63H 11/18 | 446/288 |
| 5,158,493 | A * | 10/1992 | Morgrey | A63H 11/18 | 180/8.6 |
| 6,629,871 | B1 * | 10/2003 | Liu | A63H 11/18 | 446/353 |
| 8,210,891 | B2 * | 7/2012 | Brumagin | A63H 3/46 | 446/376 |
| 2002/0193045 | A1 * | 12/2002 | Lee | A63H 11/10 | 446/330 |

FOREIGN PATENT DOCUMENTS

| | | | | |
|---|---|---|---|---|
| JP | 2002-306858 | A | | 4/2001 |
| JP | 2004-154183 | A | | 11/2002 |
| JP | 3095851 | | | 8/2003 |
| JP | 3095851 | U | * | 8/2003 |
| KR | 10-2010-0100119 | A | | 3/2009 |
| KR | 10-2014-0084717 | A | | 12/2012 |
| KR | 20-2013-0002818 | | | 5/2013 |
| KR | 20-0477459 | | | 6/2015 |

OTHER PUBLICATIONS

PCT/KR2016/009889 received an International Search and Written Report dated Dec. 7, 2016, 11 pages, English copy of Search Report included.

* cited by examiner

CONNECTING MEMBER FOR SELF-ASSEMBLY TOY

TECHNICAL FIELD

The present disclosure relates to a block toy coupled to other block toys to create various shapes and obtaining learning effect and enjoying play with a toy.

The present disclosure relates to a connection member of a self-assembly toy, and more particularly, to a connection member of a self-assembly toy capable of walking.

BACKGROUND ART

As toys for intellectual development of toddlers or children, self-assembly block toy sets including a plurality of blocks of various shapes that may be assembled to make any type of artifact are being widely used. Such a self-assembly block toy set allows a child to assemble an artifact of various shapes according to imagination, and may be repeatedly used, that is, disassembling the artifact and making another type of artifact, and the self-assembly block toy set helps brain activity and intellectual development of children by stimulating creativity and imaginative power of children. Blocks mostly have a connection member. The connection member may have various shapes according to an engaging structure or an assembling location.

In addition, connection members are provided in various shapes, and thus, children may assemble the blocks in various shapes or may assemble toys delicately. Toys of various shapes may be manufactured according to how to use which kinds of connection members, and imaginary power of the children may be improved.

DETAILED DESCRIPTION OF THE INVENTION

Technical Problem

According to an aspect of the present disclosure, a block toy is able to creatively generate various shapes by coupling to other block toys.

Technical Solution

Provided is a block toy capable of creating various shapes that are movable through coupling to a block toy including a motor.

Advantageous Effects of the Invention

According to the present disclosure, various shapes that are movable may be created through coupling between block toys including a motor.

According to the present disclosure, children may assembly blocks in various shapes by coupling block toys of various shapes and may fabricate toys delicately.

BEST MODE

Figure 1:
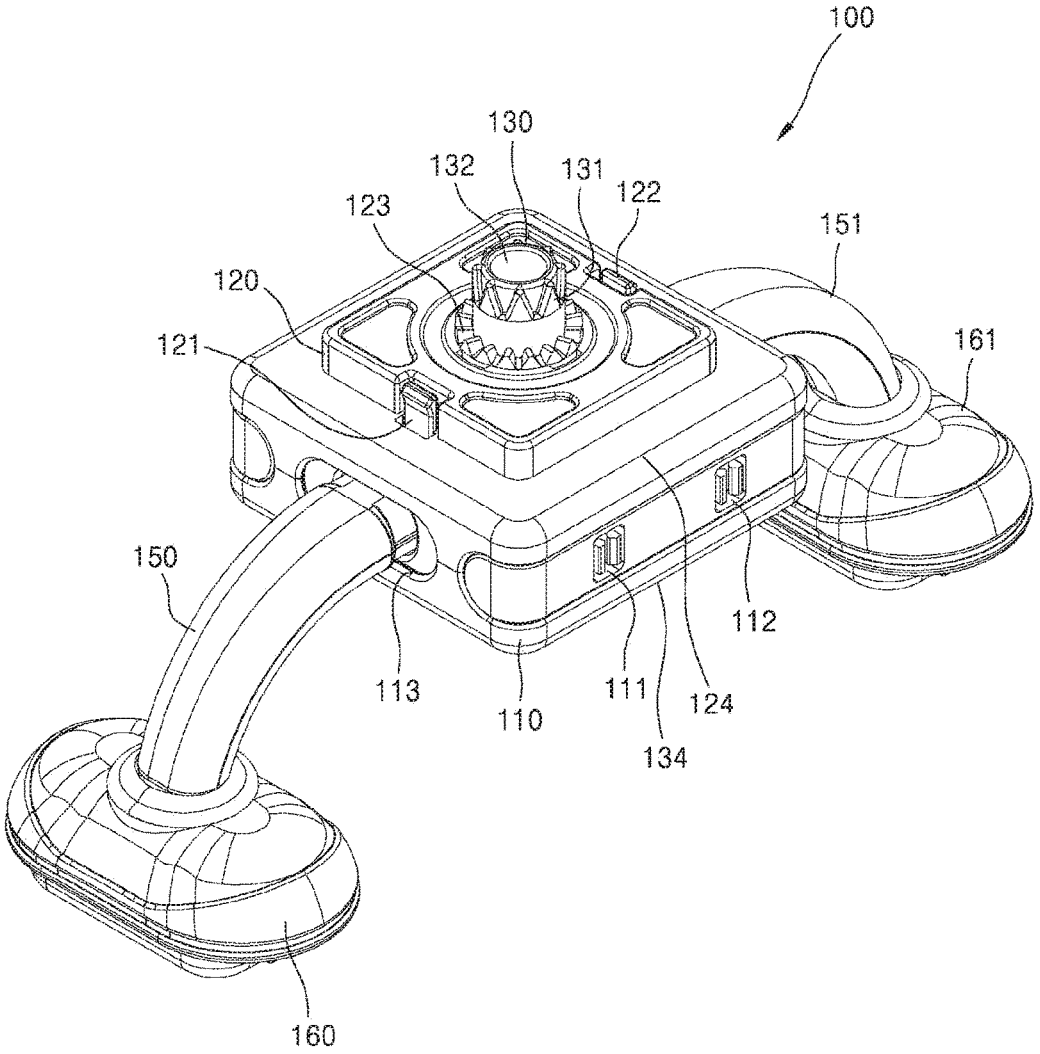
FIG. 1 is a diagram of an assembly connection member according to an embodiment of the present disclosure.

As an embodiment of the present disclosure, a connection member of an assembly toy, the connection member includes: a body formed as a solid figure similar to a rectangular parallelepiped, and including a circular opening in a center of an upper surface and openings of oval shapes in a left side surface and a right side surface; a leg protruding out of the body through the openings of the oval shapes in the left and right side surfaces of the body; and foot models respectively connected to left and right end portions of the leg, a circular protruding connector is a cylindrical connector inserted into the body, wherein an end of the circular protruding connector protrudes from the opening in the center of the upper surface of the body and an opposite end of the circular protruding connector is coupled to a walk controlling art in the body, wherein the walk controlling arm is coupled to the leg.

Preferably, the walk controlling arm may include a hooking step of a circular shape and three arms provided in a '□'-shape and connected to the hooking step of the circular shape, wherein a surface of the hooking step of the circular shape is coupled to the circular protruding connector, one of the three arms is connected to a side of an opposite surface of the hooking step, and the one arm and the other arms are directly or indirectly connected to the leg, and when the circular protruding connector rotates, the hooking step of the circular shape may rotate, and accordingly, a location of the arm coupled to the hooking step of the circular shape is changed, and a location of the leg connected to the arm and another arm may be changed.

Preferably, when the circular protruding connector rotates, a shape of the walk controlling arm coupled to the circular protruding connector may vary, and when the shape of the walk controlling arm varies, the leg coupled to the walk controlling arm may move to walk.

Preferably, each of the foot models may include a wheel in a bottom surface, the wheel including protrusions on a surface thereof, and the wheel provided in the bottom of the foot may move in a direction, when the wheel is about to move in a different direction, the protrusions on the surface of the wheel may be hooked by a stopper provided in the foot model to restrict the movement of the wheel.

Preferably, each of the foot models may include a wheel in a bottom and a circular protrusion that protrudes from the bottom to a height of the wheel for balancing, the wheel including protrusions on a surface thereof, and when the wheel moves forward, a driving axis of the wheel may move to a rear surface of a hooking step in the foot model, in which the driving axis is inserted, to move the wheel, and when the wheel moves backward, the driving axis of the wheel may be moved to a front surface of the hooking step in the foot model, and the protrusions on the surface of the wheel are hooked by a stopper provided in the foot model to restrict the movement of the wheel.

MODE OF THE INVENTION

Hereinafter, one or more embodiments of the present disclosure will be described in detail with reference to accompanying drawings. The embodiments are provided so that this disclosure will be thorough and complete, and will fully convey the concept of the present disclosure to those skilled in the art. As the present disclosure allows for various changes and numerous embodiments, particular embodiments will be illustrated in the drawings and described in detail in the written description. However, this is not intended to limit the present disclosure to particular modes of practice, and it is to be appreciated that all modifications, equivalents, and/or alternatives that do not depart from the spirit and technical scope are encompassed in the present disclosure. When describing the drawings, like reference numerals in the drawings denote like elements. In the accompanying drawings, sizes of components in the drawings may be exaggerated or reduced for clearing the present disclosure.

The terms used in the present specification are merely used to describe particular embodiments, and are not intended to limit the present disclosure. An expression used in the singular encompasses the expression of the plural, unless it has a clearly different meaning in the context. In the present specification, it is to be understood that the terms such as "including," "having," and "comprising" are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

Unless otherwise defined, all terms (including technical and scientific terms) used herein have the same meanings as commonly understood by one of ordinary skill in the art to which this invention belongs. Such terms as those defined in a generally used dictionary are to be interpreted to have the meanings equal to the contextual meanings in the relevant field of art, and are not to be interpreted to have ideal or excessively formal meanings unless clearly defined in the present disclosure.

Hereinafter, a block toy according to the present disclosure will be described in detail with reference to accompanying drawings. For convenience of description, a block toy of a circular shape is described, but the present disclosure is not limited thereto, that is, the block toy may be provided in various shapes, e.g., a triangular shape, a polygonal shape, a fan shape, a trapezoidal shape, etc.

Figure 2:
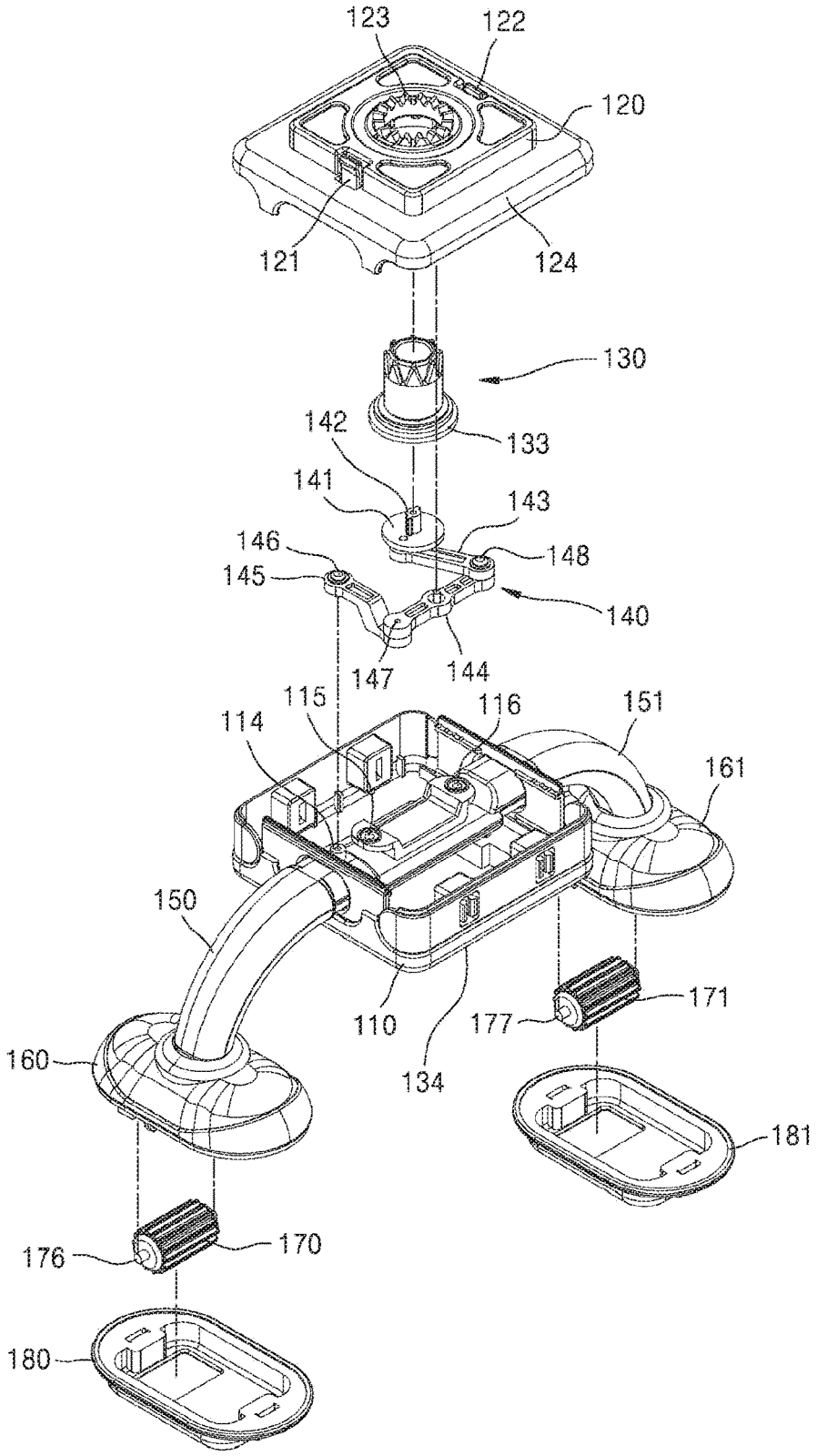
FIG. 2 is an exploded perspective view of an assembly connection member according to an embodiment of the present disclosure.

FIGS. 1 and 2 are respectively a diagram and an exploded perspective view of an assembly connection member 100, according to an embodiment of the present disclosure.

The assembly connection member 100 includes a body, in which an upper body 124 and a lower body 110 are coupled to each other, legs 150 and 151, and foot models 160 and 161.

The body 124 and 134 is a cubic figure similar to a rectangular parallelepiped, an opening 123 of a circular shape is formed in a center of an upper surface of the upper body 124, and triangular protrusions are arranged around a circumference of the opening 123. When another block toy or a motor is coupled to the circular protruding connector 130, the triangular protrusions may prevent the coupling from being difficult or prevent easy detachment along a surface of the circular protruding connector 130.

The body 124 and 134 includes square protrusions (120 of FIG. 1 and 140 of FIG. 6) on upper and lower surfaces thereof. The square protrusions (120 of FIG. 1 and 140 of FIG. 6) are formed as squares smaller than the upper surface or the lower surface of the body. The square protrusions (120 of FIG. 1 and 140 of FIG. 6) are provided to make additional assembling of toys, magnet toys, motors, etc. easy, and may further include connection hinges (121 and 122 of FIGS. 1 and 141 and 142 of FIG. 6) at centers of opposite longitudinal surfaces. The body 124 and 134 include two connection hinges 111 and 112 in each of left and right side surfaces thereof. The connection hinges 111 and 112 are used in connecting and coupling an assembling toy to another toy.

The body 124 and 134 includes openings 113 of an oval shape in a left side surface (not shown) and a right side surface, and the legs 150 and 151 protrude from the body through the openings 113 of the oval shape formed in the left side surface (not shown) and the right side surface. Also, the foot models 160 and 161 are provided at lower ends of the legs 150 and 151 at left and right sides.

The legs 150 and 151 are shown to be separated from each other in FIG. 1, but they may be implemented as one arch shape so that a part may be inserted to an opening of an oval shape in the left side surface of the body and the other part may be inserted to the opening 113 of an oval shape in the right side surface of the body.

Referring to FIG. 2, the legs 150 and 151 are coupled to the upper body 124 via connectors 115 and 116 in the body, and are engaged with a first arm 143 of a walk controlling arm 140. Circular hooking steps 141 and 142 included in the walk controlling arm 140 are engaged with a lower end 133 of a circular protruding connector 130. In addition, a cylindrical connector portion of the circular protruding connector penetrates through a circular opening 123 in the upper surface of the upper body 124 to protrude therefrom.

The walk controlling arm 140 includes the circular hooking steps 141 and 142, and three arms connected to a lower end of the circular hooking step 141 in a ' E'-s h ape, that is, the first arm 143, a second arm 144, and a third arm 145. The third arm 145 is inserted to a circular step 114 of the leg.

When the circular protruding connector 130 rotates, the circular hooking steps 141 and 142 also rotate, and accordingly, a location of the first arm 143 coupled to the circular hooking step 141 is changed. Accordingly, locations of the second arm 144 and the third arm 145 inserted to the circular step 114 of the leg 150 are changed, and thus, locations of the legs 150 and 151 directly or indirectly connected to the first arm 143 and the third arm 145 and locations of the foot models 160 and 161 are changed.

Figure 3A:
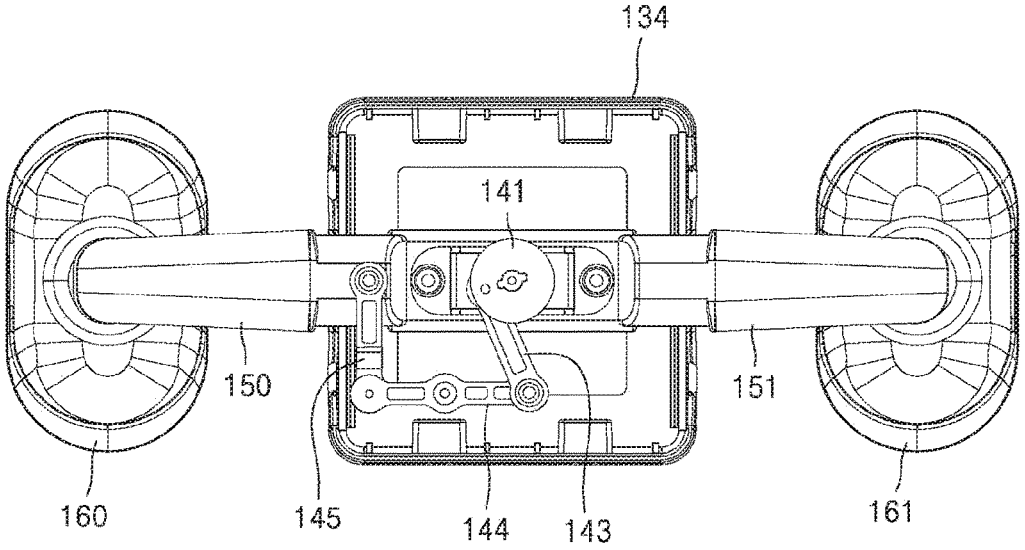
FIGS. 3A to 3C are diagrams showing moving aspects of a walking control arm and legs when a protruding circular connection portion is rotated, according to an embodiment of the present disclosure.
Figure 3B:
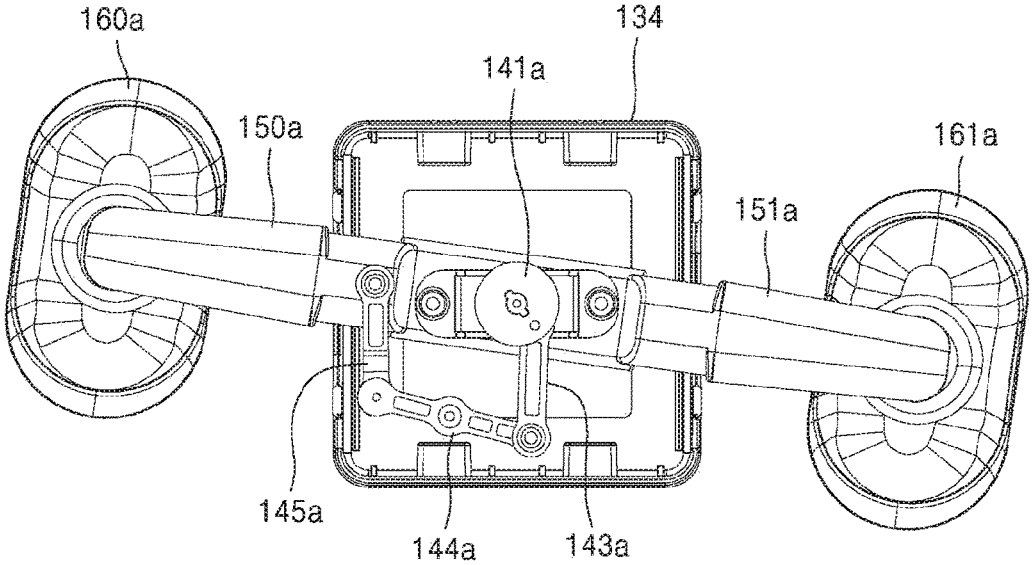
Figure 3C:
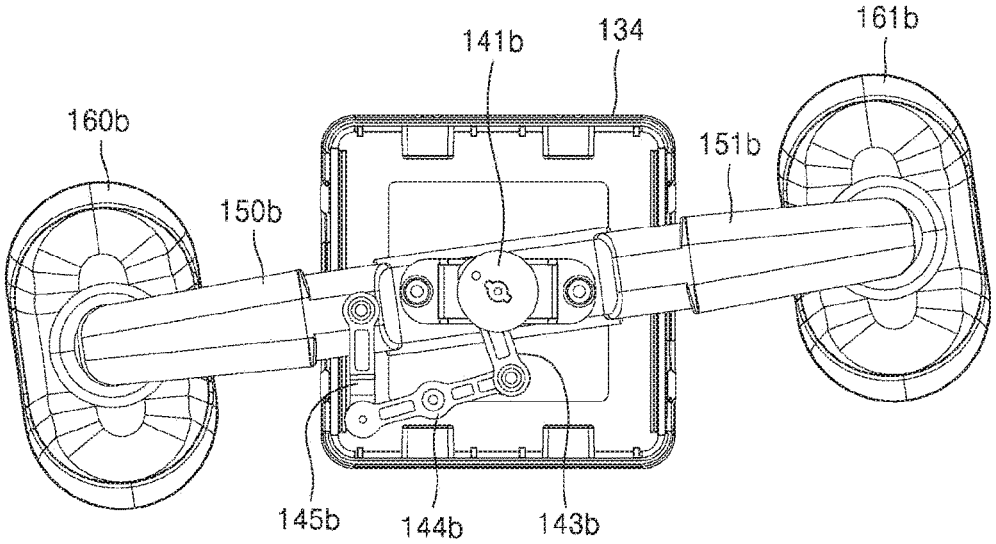

FIGS. 3A to 3C show variations in the locations of the legs 150 and 151 and the locations of the foot models 160 and 161 when the circular protruding connector 130 of FIGS. 1 and 2 rotates.

FIG. 3A shows an example in which the legs 150 and 151 and the foot models 160 and 161 are arranged in a straight line. Referring to FIGS. 1 and 2 together, the second arm 144 and the third arm 145 configuring the walk controlling arm 140 are in right angles with respect to each other.

FIG. 3B shows an example in which a left leg 150*a* and a left foot model 160*a* are preceding a right leg 151*a* and a right foot model 161*a*. Referring to FIGS. 1 and 2 together, the second arm 144 and the third arm 145 configuring the walk controlling arm 140 are in obtuse angles with respect to each other. That is, due to the rotation of the circular protruding connector 130, the third arm 145 connected to the left leg 150*a* moves forward.

FIG. 3C shows an example in which the right leg 151*b* and the right foot model 160*b* are preceding the left leg 150*b* and the left foot model 160*b*. Referring to FIGS. 1 and 2 together, the second arm 144 and the third arm 145 configuring the walk controlling arm 140 are in acute angles with respect to each other. That is, due to the rotation of the circular protruding connector 130, the third arm 145 connected to the left leg 150*a* moves backward.

Figure 4A:
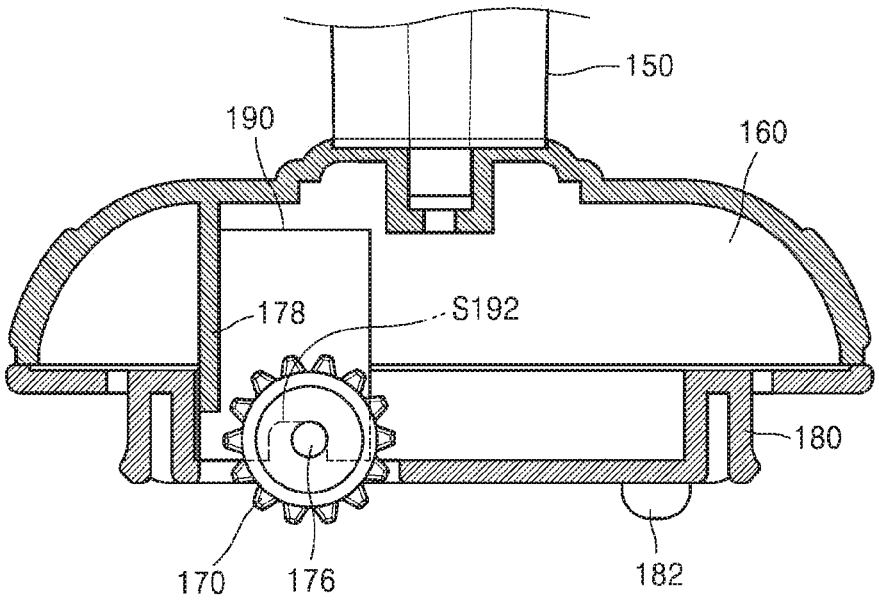
FIGS. 4A and 4B are cross-sectional views when the foot models move forward or backward, according to an embodiment of the present disclosure.
Figure 4B:
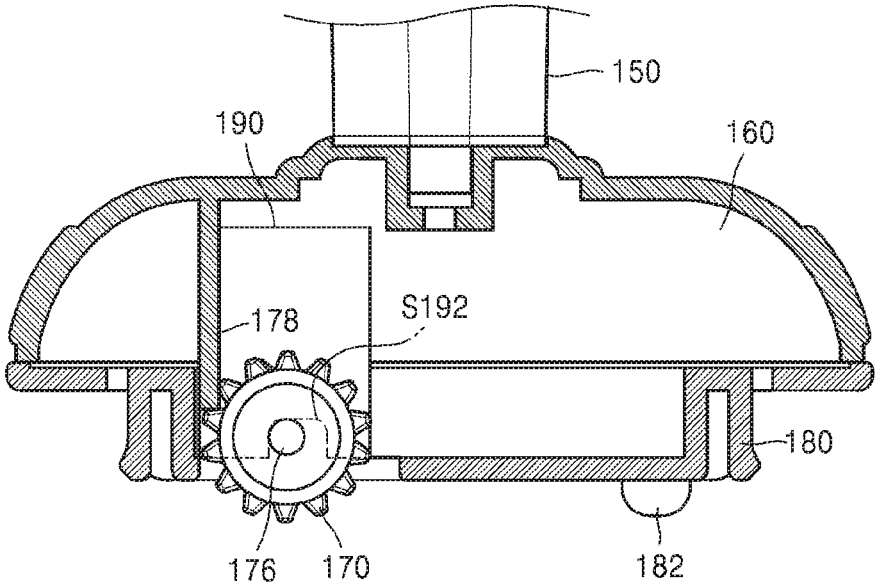
Figure 5:
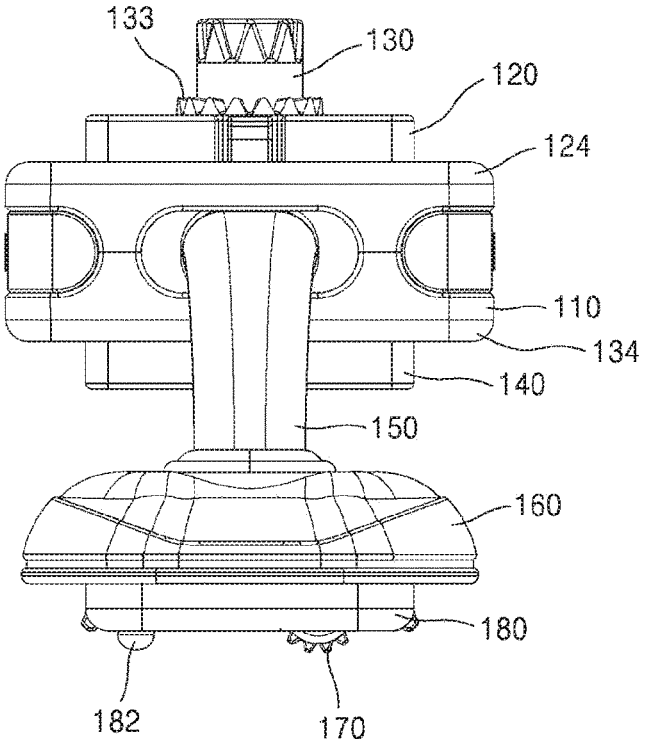
FIG. 5 is a side view of an assembly connection member according to an embodiment of the present disclosure.

FIGS. 4A and 4B are cross-sectional views when the foot models move forward or backward, according to an embodiment of the present disclosure. This will be described with reference to FIG. 2 as follows.

Figure 6:
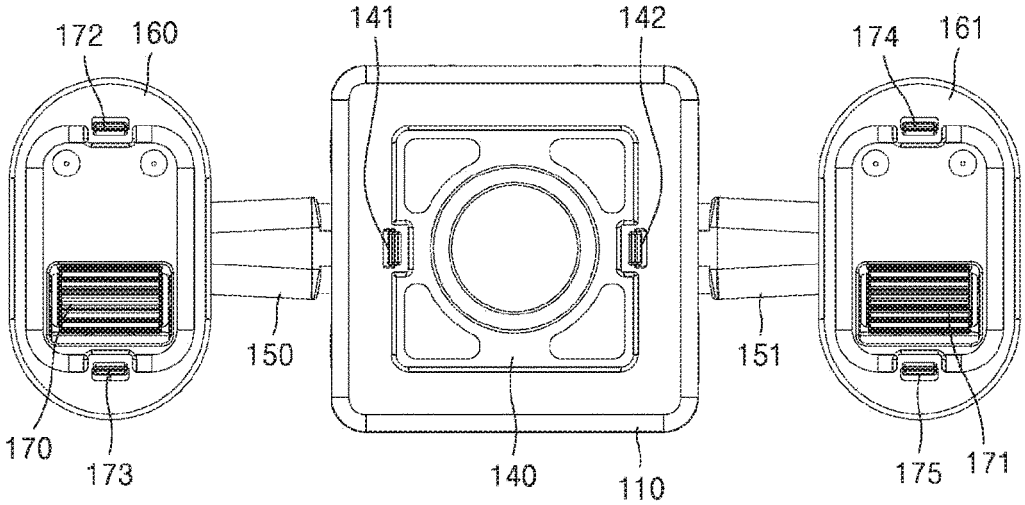
FIG. 6 is a bottom view of an assembly connection member according to an embodiment of the present disclosure.

The foot model includes upper surfaces 160 and 161 of a dome shape, wheels 170 and 171, driving axes 176 and 177 of the wheels, and bottom surfaces 180 and 181 in which grooves are formed. The bottom surfaces 180 and 181 include a circular protrusion 182 that protrudes to a height of the wheels, and connection hinges 172, 173, 174, and 175 as shown in FIG. 6.

The wheels 170 and 171 are inserted in the recesses of the bottom surfaces 180 and 181, and the driving axes 176 and 177 of the wheels 170 and 171 are inserted to hooking steps S192 in the foot models. Protrusions are provided on a surface of the wheels.

FIG. 4A shows an example in which the wheels 170 and 171 move forward. When the wheels 170 and 171 move forward, the driving axes 176 and 177 of the wheels move to a rear surface of the hooking step S192 in the foot models, in which the driving axes 176 and 177 are inserted, to move the wheels.

FIG. 4B shows an example in which the wheels 170 and 171 move backward. When the wheels 170 and 171 move backward, the driving axes 176 and 177 of the wheels are moved toward a front surface of the hooking step S192 in the foot models, in which the driving axes 176 and 177 are inserted, and thus, the protrusions on the surfaces of the wheels are hooked by stoppers 178 in the foot models and are restricted to move.

While one or more embodiments have been described with reference to the figures, it will be understood by those of ordinary skill in the art that various changes in form and details may be made therein without departing from the spirit and scope as defined by the following claims.

The invention claimed is:

1. A connection member of an assembly toy, the connection member comprising:

a body having a rectangular parallelepiped shape, the body having a circular opening in a center of an upper surface of the body and oval-shaped openings in a left side surface and a right side surface of the body;

a leg protruding out of the body through the oval-shaped openings in the left side surface and the right side surface;

foot models respectively connected to a left and a right end portion of the leg;

a circular protruding connector positioned within the body, wherein a first end of the circular protruding connector protrudes from the circular opening in the center of the upper surface of the body and is configured to interface with a corresponding connector of a different connection member; and a walk controlling arm positioned within the body that is operably coupled to a second end of the circular protruding connector at a location offset from a center of the circular protruding connector, the walk controlling arm comprising:

a first arm operably coupled to the second end of the circular protruding connector;

a second arm operably coupled to the first arm;

a third arm operably coupled to the second arm and the leg; and wherein the walk controlling arm is configured to move the leg in response to rotation of the circular protruding connector.

2. The connecting member of claim 1, wherein:

the walk controlling arm comprises a hooking step of a circular shape and the first arm, second arm, and third arm form a 'C'-shape, with the first arm connected to the hooking step of the circular shape at the location offset from the center of the circular protruding connector, the second arm connected to the first arm at an end opposite the hooking step of the circular shape, and the third arm connected to the second arm at an end opposite the second arm;

a surface of the hooking step of the circular shape is coupled to the circular protruding connector;

the first arm is connected to a side of an opposite surface of the hooking step, and the third arm is connected to the leg; and when the circular protruding connector rotates, the hooking step of the circular shape rotates, and accordingly, a location of the first arm coupled to the hooking step of the circular shape is changed, and a location of the leg connected to the third arm is changed so as to engage the leg.

3. The connection member of claim 2, wherein the second arm is pivotally connected to the body at a middle portion of the second arm such that movement of the first arm causes movement of the third arm.

4. The connecting member of claim 1, wherein, when the circular protruding connector rotates, a portion of the walk controlling arm coupled to the circular protruding connector moves and varies a shape of the walk controlling arm so as to cause a portion of the walk controlling arm coupled to the leg to move thereby moving the leg to walk.

5. The connection member of claim 1, wherein:

each of the foot models comprises a wheel in a bottom surface of each of the foot models, the wheel including protrusions on a surface thereof, and when each of the foot models moves in a first direction the wheel provided in the bottom surface of the foot model moves in a second direction and the protrusions on the surface of the wheel contact a stopper in the foot model to restrict a rotation of the wheel.

6. The connection member of claim 1, wherein each of the foot models comprises:

a wheel in a bottom of the foot models including protrusions on a surface of the wheel;

a circular protrusion that protrudes from the bottom to a height of the wheel for balancing; and wherein when the foot model moves forward, a driving axis of the wheel moves to a rear surface of a hooking step in the foot model and moves the wheel with the driving axis, and when the foot model moves backward, the driving axis of the wheel is moved to a front surface of the hooking step in the foot model, and the protrusions on the surface of the wheel are hooked by a stopper provided in the foot model to restrict a rotation of the wheel.

* * * * *